United States Patent [19]

Elkins

[11] 4,119,125

[45] Oct. 10, 1978

[54] METHOD AND APPARATUS FOR HANDLING LIQUID SAMPLES

[76] Inventor: Carlos D. Elkins, 1414 S. Fairplain Ave., Whittier, Calif. 90601

[21] Appl. No.: 808,820

[22] Filed: Jun. 22, 1977

[51] Int. Cl.[2] ..... B65B 3/04

[52] U.S. Cl. ..... 141/11; 23/230 R; 23/230 B; 210/DIG. 23; 141/318; 422/100

[58] Field of Search ..... 23/259, 230 R, 230 B, 23/292, 258.5; 233/1 A; 210/DIG. 23; 141/11, 113, 318

[56] References Cited

U.S. PATENT DOCUMENTS

| | | | |
|---|---|---|---|
| 3,481,477 | 12/1969 | Farr | 23/259 X |
| 3,508,653 | 4/1970 | Coleman | 210/DIG. 23 |
| 3,586,064 | 6/1971 | Brown et al. | 23/259 X |
| 3,721,528 | 3/1973 | Mead et al. | 23/259 X |
| 4,035,294 | 7/1977 | Landers et al. | 210/DIG. 23 |

*Primary Examiner*—R.E. Serwin

*Attorney, Agent, or Firm*—Fulwider, Patton, Rieber, Lee & Utecht

[57] ABSTRACT

Method and apparatus for handling a liquid sample such as a blood sample, which has been processed to obtain phase separation of the sample's components. The apparatus includes a cup for containing a quantity of the separated fluid phase of the sample, a suction cylinder and probe usable with the cup for extracting the fluid phase and an associated container for holding the remainder of the sample. Preferably, the cup has a specific configuration which provides for nesting within the top portion of the container and concurrently provides for tight sliding engagement with the inside surface of the suction cylinder to extract the fluid phase by a piston-like cooperation. An optional thin sleeve may be inserted over the bottom portion of the cup, prior to nesting, to prevent contamination of the outside walls thereof. The method includes introducing a phase separable liquid sample into the container, processing the sample to obtain separation of at least one fluid phase and extracting a quantity of fluid phase, with the probe and suction cylinder, into the cup. Thereafter, the probe and suction cylinder are removed, and the cup containing the fluid phase is capped and nested within the top portion of the container. Preferably, the nested cup and container are coded with a two-part break-away label which is affixed to their outside walls adjacent the juncture of their contact.

12 Claims, 12 Drawing Figures

METHOD AND APPARATUS FOR HANDLING LIQUID SAMPLES

BACKGROUND OF THE INVENTION

This invention relates to a method and apparatus for laboratory handling of liquid samples such as body fluids containing particulate components. In more detail, the present invention provides a convenient and inexpensive system for extracting a separated fluid phase from the sample and also provides means for coordinating the extracted phase with the remainder of the sample.

In the field of clinical testing, the analysis of liquid samples such as body fluids containing particulate components, is commonly performed to quantitatively and qualitatively determine the constituents present. The results of such analysis provides a valuable diagnostic tool which aids in the determination of pathological conditions in the body and in detection of various diseases.

The procedures carried out in analysis of a body fluid, such as a blood sample, are well known and do not form part of the present invention. However, there are numerous problems encountered by laboratory technicians in connection with the handling of these samples. Typically, a blood sample obtained from a patient is drawn into a test tube which is thereafter capped and sent to a laboratory for testing. In the laboratory, the test tube containing the blood sample is centrifuged to separate particulate matter, such as blood cells, from fluid phase, such as serum or plasma. After centrifuging, the fluid phase of the sample normally floats as a distinct upper layer separate from the particulate components which are concentrated in the lower portion of the test tube.

Many prior attempts have been made to prevent recombining of separated phases in a processed sample. When successful, several analyses of the separated fluid phase can be performed over prolonged periods of time without the need for extracting additional samples from the patient. One such attempt, disclosed in U.S. Pat. No. 3,780,935, has suggested the use of a physical barrier or sealant between the separated phases of the sample.

Another prior attempt to maintain the integrity of separated sample phases has suggested that the extracted fluid phase be isolated in a separate vial. However, due to a very large number of different samples being analyzed by a laboratory, there is an increased likelihood that isolated vials will become disassociated from the remainder of the original sample. Should this occur, and if additional fluid phase analyses are required, it may be necessary to extract additional samples from the patient and in effect, start the analysis over again.

A further problem related to laboratory handling of liquid samples, such as body fluids, is that of contamination. Quite frequently, in connection with communicable diseases, the inside portion of the sample container will be contaminated, particularly in the area where a cap has been used to cover the container during shipment to the laboratory. Consequently, technicians are exposed to a direct threat of contamination by handling the container and an indirect threat by handling equipment, such as pipettes, used to transfer the sample.

The present invention overcomes the foregoing deficiences of the prior devices related to liquid sample analysis and provides an improved method and apparatus for sample handling which achieves an accurate analysis with diminished likelihood of contamination.

SUMMARY OF THE INVENTION

The present invention resides in a novel method and apparatus for handling a liquid sample such as a body fluid containing particulate matter, which has been processed, for example, by centrifuge or by precipitation, to obtain phase separation of the components. Further, the present invention provides means for coordinating fluid phase with the remainder of the original sample after the fluid phase has been extracted.

In accordance with one important aspect of the present invention, the apparatus includes a cup for containing a quantity of the fluid phase, a suction cylinder and probe usable with the cup for extracting the fluid phase, and an associated container for holding the remainder of the original sample.

Preferably, the cup has a specific configuration which provides for nesting within the top portion of the container and concurrently provides for tight sliding engagement with the inside surface of the suction cylinder to extract the fluid phase in a piston-like manner. In the preferred embodied form, the cup comprises an enlarged cylindrical upper portion having an outside diameter substantially equal to the internal diameter of the suction cylinder and terminating in an open end and a lower cylindrical portion of reduced diameter having a substantially flat closed end to permit the cup to be free standing on a flat surface.

When the upper portion of the cup is inserted into an open end of the suction cylinder the combination can be utilized to draw fluid through the probe which is attached to a small diameter orifice opposite the open end of the suction cylinder. Thereafter, the foregoing members may be inverted to assist the flow of fluid from the cylinder and probe into the cup.

In one embodied form, an aspirator straw of the suction probe is provided with a pointed end, formed from a rigid material such as metal or dense plastic. This enables the straw to be directly inserted through the middle of a soft stoppered sample container. Alternatively, for use with an unstoppered container, the suction probe may be provided with a centering cup which ensures proper insertion of the probe into the sample container.

Preferably, the container, suction cylinder and probe are composed of an inexpensive and disposable material for one time use to eliminate the necessity for sterilization and diminish the likelihood of contamination. In this regard, an optional thin sleeve, may be inserted over the bottom portion of the cup, prior to nesting within the original sample container. The sleeve will remain in the sample container when the cup is removed, thereby providing an insulating barrier between the inside sidewall of the sample container and the cup.

In accordance with another important aspect of the invention, the method comprises the steps of introducing a liquid sample into the container, processing the sample to obtain phase separation, extracting the desired quantity of fluid phase into the cup by utilizing the probe and suction cylinder and nesting the cup containing the extracted fluid, within the container holding the remainder of the sample.

Once the fluid phase has been extracted from the container, the fluid phase can be subjected to requisite analyses. Upon completion of the requisite analysis, the cup can be reinserted into the top of the container to be maintained with the remainder of the original sample.

A still further feature of the present invention is the use of a break-away label which can be separated into two individual parts. Thus, both the cup holding the extracted fluid, and the original container may be coded with the same identifying number. Preferably, the break-away label is affixed, for example, by pressure sensitive adhesive to their outside walls adjacent the juncture of their contact. This ensures that even if the cup and container become separated, they can be readily identified in the laboratory and replaced together.

Other objects and advantages will become apparent from the following description taken in conjunction with the accompanying drawings, which disclose, by way of example, the principles of the invention.

DESCRIPTION OF THE PREFERRED EMBODIMENTS

Figure 1:
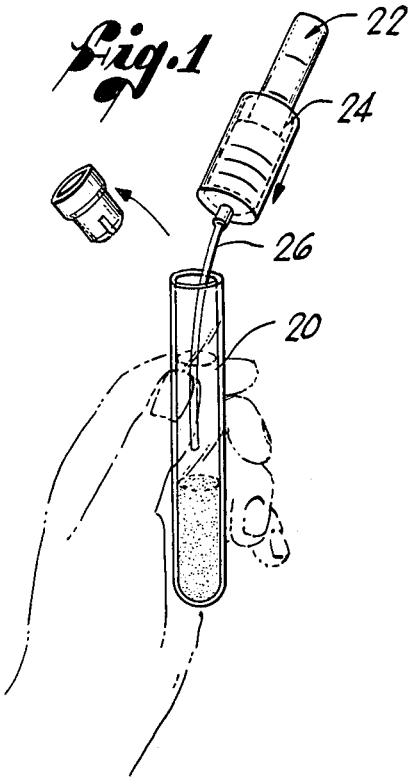
FIG. 1 is a perspective view illustrating a container having a phase separated liquid sample therein, and further illustrating a suction probe, suction cylinder and cup being utilized to extract a fluid phase in accordance with the present invention.

Referring to the drawings, the present invention is concerned with a method and apparatus for handling liquid samples. The invention is especially applicable for handling body fluids containing particulate components such as blood samples which have been processed to obtain phase separation.

Typically, a liquid sample, such as a blood sample, is centrifuged in order to separate the fluid phase, for example, serum or plasma, from particulate matter, for example, blood cells, soon after blood has been drawn from a patient. The fluid phase is thereafter subjected to quantitative and qualitative analyses which provides a valuable diagnostic tool.

As used herein, the term "phase" is meant to connote a physically separable and distinct component which is not homogeneous with the remainder of the liquid sample. Accordingly, phase separation may result from a differentiation in density as well as physical state, i.e., solid, gas, liquid.

In accordance with the present invention, as shown in FIG. 1, the apparatus comprises a container 20 for holding a liquid sample to be used, a cup 22 for containing a quantity of a separated fluid phase, a suction cylinder 24 and suction probe 26 usable with the cup 22 for extracting the fluid phase from the separated sample. Preferably, the cup 22 has a specific configuration which provides for nesting within the top portion of the container 20 and concurrently provides for tight sliding engagement with the inside surface of the suction cylinder 24 to extract the fluid phase in a piston-like manner.

Figure 2:
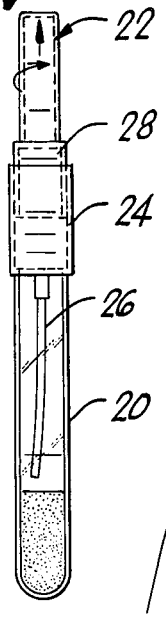
FIG. 2 is a sectional view illustrating the cup in an extended position whereby a portion of the fluid phase is withdrawn from the container and into the suction probe and cylinder.
Figure 3:
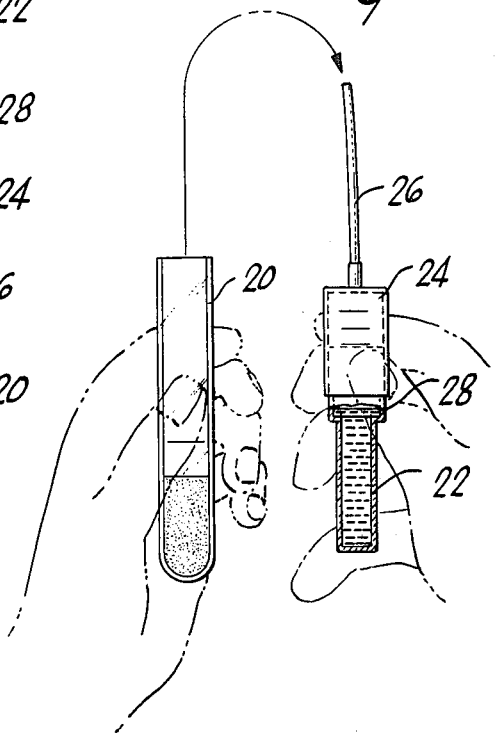
FIG. 3 is a sectional view illustrating the cup in an inverted position containing the extracted fluid phase with suction probe and cylinder attached to the cup.
Figure 4:
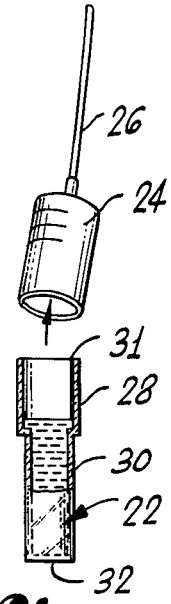
FIG. 4 is a partially sectional view showing the cup containing the fluid phase with the suction probe and cylinder removed.

As shown most clearly in FIGS. 2, 3 and 4, in the preferred embodied form, the cup 22 includes an enlarged cylindrical upper portion 28 having an outside diameter substantially equal to the internal diameter of the suction cylinder 24 and terminating in an open end, and a lower cylindrical portion 30 of reduced diameter having a substantially flat closed end 32. When the upper portion 28 is inserted into the open end of the cylinder 24, the cup 22 can be utilized to draw fluid from the container 20 into the probe 26 and cylinder 24. Thereafter, the cup 22, cylinder 24 and probe 26 may be inverted, to assist the flow of fluid from the probe 26 and cylinder 24 to the cup 22.

Figure 5:
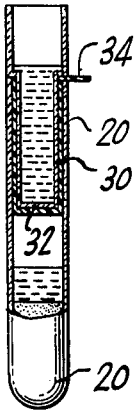
FIG. 5 is a further sectional view illustrating the cup with a sleeve thereon, and further illustrating the cup and sleeve nested within the top portion of the container.

As best shown in FIG. 4, the flat closed end 32 of the cup 22 permits the cup 22 to be free standing on a flat surface such as a laboratory table. Further, to provide for nesting, (as illustrated in FIG. 5) the lower end portion 32 of the cup 22 has an outside diameter slightly less than the internal diameter of the top portion of the container 20.

A method for handling a phase separable liquid sample in accordance with the present invention comprises the steps of introducing the liquid sample into a container, processing the sample to obtain substantial separation of at least one fluid phase from the remainder of the sample, withdrawing the separated fluid phase into a cup by utilizing a suction cylinder and probe which cooperates with the cup to extract the fluid phase from the sample container.

While the container 20 is depicted in the drawings as a test tube such as VACUTAINER brand sold by Becton, Dickinson & Co., those skilled in the art will readily appreciate that the container may be of any configuration which provides means for holding the liquid sample. Moreover, the configuration of the container should facilitate phase separation of the liquid sample by the separation technique employed, e.g., centrifugal force, precipitation, flocculation, sedimentation, etc. Volume indicia may be disposed along the cup wall for indicating and measuring liquid sample volumes. Optionally, a thin sleeve 34 composed of an inexpensive plastic or metal foil can be inserted over the end portion of the cup 22 prior to nesting within the container 20. When nested within the container, the sleeve 34 separates the inner wall of the container 20 from the outer wall of the cup 22 and upon removal of the cup 22 from the container 20, the sleeve will remain in place in the top portion of the container to form a barrier and prevent the outside of the cup from becoming contaminated when reinserted into the container.

Figure 6:
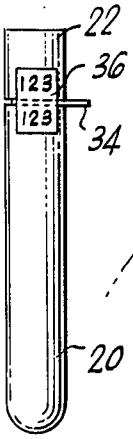
FIGS. 6–8 are perspective views showing successive stages of affixing a two-part break-away label to the outside walls of the nested cup and container in accordance with the present invention.
Figure 7:
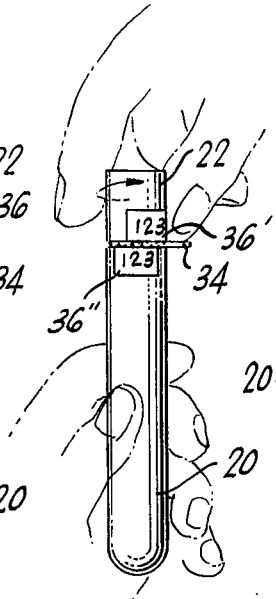
Figure 8:
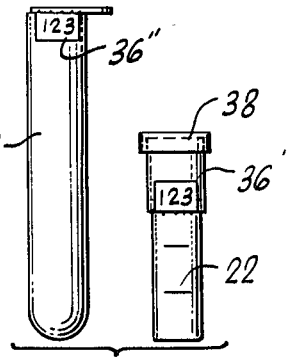

As illustrated in FIGS. 6–8, an additional feature of the present invention is the use of a two-part break-away label 36 which is marked with the same identifying code on each part. Accordingly, the break-away label 36 is affixed, such as by pressure sensitive adhesive to the outside walls of the nested cup 22 and container 20 adjacent the juncture of their contact. Once the label is affixed, the nested cup may be twisted from its initial position while the container is held steady, thereby to separate the two-parts 36', 36'', of the label 36. This coding ensures that even if the cup and container become dislodged, they can be readily identified in the laboratory and be re-coordinated. Further, a suitable cap 38 may be provided to seal the open end of the cup 22 containing the extracted fluid phase of the sample.

In view of the likelihood that the inside surface of a container holding a phase separated body fluid is contaminated by the sample, it is advantageous to withdraw the fluid phase from the container without contacting the container walls.

Figure 9:
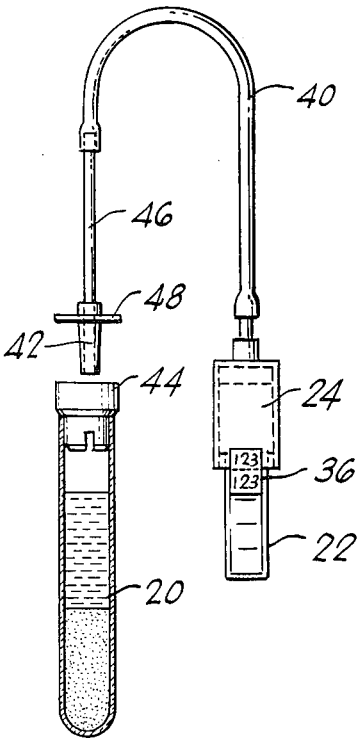
FIG. 9 is a sectional view illustrating a first embodied suction probe for direct insertion through a soft stopper mounted on a container.
Figure 10:
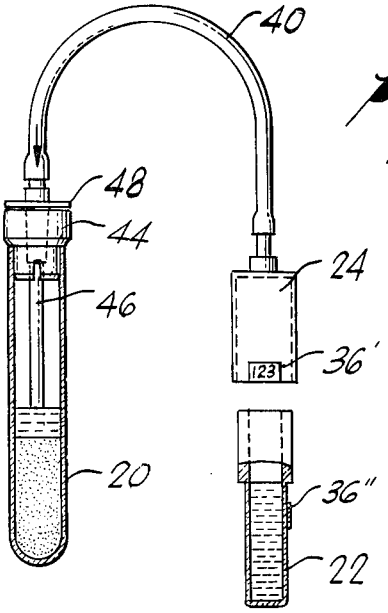
FIG. 10 is a further sectional view showing the suction probe of FIG. 9 inserted through the soft stopper of the container.

In this regard, one embodied suction probe 40, as shown in FIGS. 9 and 10, is provided with an aspirator straw 46 having a sharp end 42, formed from a rigid material such as metal or dense plastic. This structure enables the straw 46 to be directly inserted through a soft stopper 44, such as a rubber stopper mounted on a container 20.

The probe 40 further includes a slidable positioning collar 48 for centering the aspirator straw 46 when inserted through the stopper 44.

Figure 11:
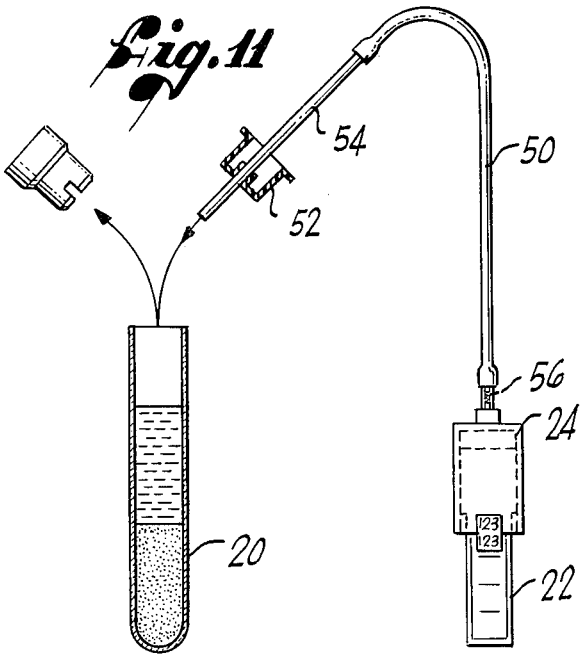
FIG. 11 is a sectional view illustrating a second embodied suction probe for use with a container having its stopper removed.
Figure 12:
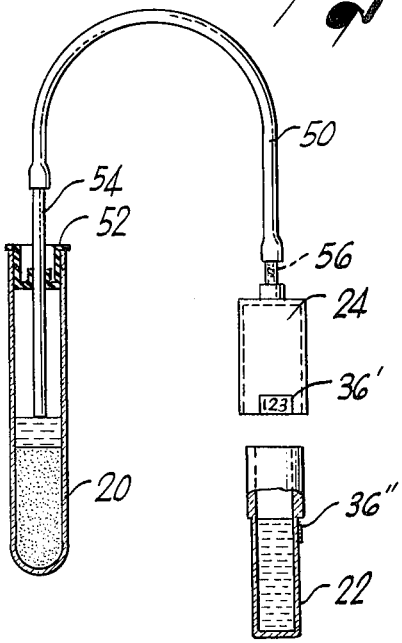
FIG. 12 is a further sectional view showing the suction probe of FIG. 11 in position on the container.

Alternatively, in a second embodied suction probe 50, shown in FIGS. 11 and 12, the probe 50, is provided with a centering cap 52 having an opening therein, which ensures proper insertion of its aspirator straw 54 into an unstoppered container 20. Further, as shown in FIG. 11, all of the embodied suction probes may include an internal filter element 56, formed from a semi-permeable material such as a compressible latex foam, for filtering out unwanted particles in the liquid phase.

Typically, the suction cylinder and probe are formed of relatively transparent resilient plastic or other inexpensive material which allows for disposal of the cylinder and probe upon completion of the suction operation. This, of course, eliminates the necessity for sterilization.

Accordingly, with the cup inserted in the suction cylinder, and probe attached to a small diameter orifice opposite the open end of the cylinder, the aspirator straw of the probe is fed into the sample container until the desired level of fluid to be extracted corresponds with the end of the aspirator straw. The fluid phase is then carefully siphoned into the cup by sliding the cup in the suction cylinder which extracts the fluid from the container by the internal vaccum thereby created. At this point, the suction probe and cylinder may be removed, and the cup, now containing the fluid phase, may be capped and nested within the top portion of the container having the remainder of the original sample.

Thus, once the fluid phase has been withdrawn from the separated sample in the container, the fluid phase can be subjected to the requisite further analyses. Upon completion of the requisite analysis, the cup can be reinserted into the top of the original sample container and maintained together therewith.

In accordance with the foregoing, it can be seen that the invention substantially eliminates the likelihood that an extracted fluid phase will become disassociated from its original sample container. Thus, the original sample may be recentrifuged if more fluid phase is required. The apparatus allows several analyses of the fluid phase to be performed over prolonged periods of time thereby reducing the need for obtaining additional samples from the patient.

All of the component parts of the apparatus of the present invention can be manufactured at relatively inexpensive cost as a single-use disposable item. The container, suction cylinder and suction probe, can be conveniently fabricated by a blow molding process using any of a number of suitable plastics or glass. Any container may be utilized, and the precise configuration is not critical to the present invention.

In particular, the invention provides a reliable technique for isolating a predetermined volume of fluid phase from a phase separated liquid sample. Although specific embodiments of the invention have been described in detail for purposes of illustration, various modifications may be made without departing from the spirit and scope of the invention. Accordingly, the invention is not to be limited except by the appended claims.

I claim:

1. Apparatus for handling a liquid sample, the apparatus comprising in combination:

a container for receiving and holding a liquid sample and having an open end and a closed end;

a cup comprising a cylindrical upper portion terminating in an open end, and a cylindrical lower portion terminating in a closed end, said upper portion having an outside diameter greater than the outside diameter of said lower portion; and suction means for extracting a predetermined amount of liquid sample from said container and into said cup, said suction means including a suction cylinder having one open end and a small diameter orifice at the opposite end thereof;

said open end of said suction cylinder having an internal diameter substantially equal to said outside diameter of the upper portion of said cup so as to provide a tight sliding engagement between said cup and said cylinder when said upper portion of said cup is positioned into said open end of said suction cylinder;

and an elongated tubular suction probe connected to the small diameter orifice of said suction cylinder whereby when the upper portion of said cup is received within the open end of said suction cylinder, said cup can be moved to cooperate with said cylinder and draw a predetermined amount of liquid sample through said probe into said suction cylinder and said cup.

2. The apparatus of claim 1 wherein the open end of said container has an internal diameter slightly greater than said outside diameter of the lower portion of said cup to provide for nesting of said cup within said container.

3. The apparatus of claim 1 and further including a sleeve having an internal diameter slightly greater than said outside diameter of the lower portion of said cup.

4. The apparatus of claim 1 wherein said suction probe includes:

an aspirator straw, a filter element located internally of said straw;

and means for orienting said aspirator straw within said container when said straw is inserted into said container.

5. The apparatus of claim 4 wherein said means for orienting said aspirator straw comprises a slidable positioning cap mounted on said straw, said cap being adaptable to fit the open end of said container.

6. The apparatus of claim 4 wherein said means for orienting said aspirator straw comprises a slidable positioning collar mounted on said straw; and means for inserting said straw through a relatively soft stopper mounted on the open end of said container.

7. Apparatus for handling a phase separable liquid sample such as a body fluid sample containing particulate components, the apparatus comprising in combination:

a container, for receiving and holding a liquid sample, including one open end having a first internal diameter and one closed end;

a cup comprising a cylindrical upper portion terminating in an open end, and a cylindrical lower portion terminating in a closed end, said upper portion having an outside diameter greater than the outside diameter of said lower portion, and said lower portion having an outside diameter slightly less than the internal diameter of the open end of said container, and suction means for extracting a predetermined amount of liquid sample from said container and into said cup, said suction means including:

a suction cylinder having one open end and a small diameter orifice at the opposite end thereof;

said open end of said suction cylinder having an internal diameter substantially equal to said outside diameter of the upper portion of said cup to provide for tight sliding engagement between said cup and cylinder when said upper portion of said cup is positioned within said open end of said suction cylinder;

and an elongated tubular suction probe connected to the small diameter orifice of said suction cylinder whereby when the upper portion of said cup is disposed within the open end of said suction cylinder, said cup can be moved to cooperate with said cylinder and draw a predetermined amount of liquid sample through said probe into said suction cylinder and said cup.

8. A method for handling a phase separable liquid sample, the method comprising the steps of:

introducing a phase separable liquid sample into a container, processing the sample to obtain substantial separation of at least one fluid phase of said sample, siphoning the separated fluid phase into a cup by utilizing suction means to extract the separated fluid phase from said container, said suction means comprising in combination a suction cylinder and an elongated tubular probe, nesting said cup within an upper portion of said container after the separated fluid phase has been siphoned into said cup.

9. The method of claim 8, further comprising the step of affixing a two-part break-away label to an outside wall of said cup and said container adjacent the juncture of their contact, whereby when said cup is twisted from the nested position on said container said label separates into two individual parts, one label part affixed to said cup and the other label part affixed to said container.

10. The method of claim 8 wherein said phase separable liquid sample is a body fluid.

11. The method of claim 8 wherein said phase separable liquid sample is a blood sample.

12. The method of claim 8 wherein said step of processing the sample is by centrifuge.

* * * * *